United States Patent [19]

Konstantouros et al.

[11] 4,388,276

[45] Jun. 14, 1983

[54] DEVICE FOR REGENERATING HYDROCHLORIC COPPER CHLORIDE ETCHING SOLUTIONS

[75] Inventors: Efthimios Konstantouros, Munich; Karl Hoeck, Benediktbeuern, both of Fed. Rep. of Germany

[73] Assignee: Siemens Aktiengesellschaft, Berlin & Munich, Fed. Rep. of Germany

[21] Appl. No.: 293,087

[22] Filed: Aug. 17, 1981

[30] Foreign Application Priority Data

Sep. 23, 1980 [DE] Fed. Rep. of Germany ..... 3035864

[51] Int. Cl.[3] ..... C03C 25/06

[52] U.S. Cl. ..... 422/187; 137/386; 156/345; 156/642; 261/36 R; 261/64 D; 261/109; 422/106; 423/38

[58] Field of Search ..... 423/38, 39, 493; 156/642, 345; 137/386; 261/112, 64 D, 115, 261/109, 36 R; 422/106, 108, 110, 111, 187

[56] References Cited

U.S. PATENT DOCUMENTS

| | | | |
|---|---|---|---|
| 1,514,939 | 11/1924 | Wallace | 261/64 D |
| 2,771,460 | 11/1956 | Kooistra | 261/103 |
| 3,306,792 | 2/1967 | Thurnel | 156/642 |
| 3,883,309 | 5/1975 | Ishizawa | 422/106 |
| 4,042,444 | 8/1977 | Snyder | 156/642 |
| 4,101,608 | 7/1978 | Bracey | 261/64 D |

*Primary Examiner*—Richard L. Chiesa

*Attorney, Agent, or Firm*—Hill, Van Santen, Steadman, Chiara & Simpson

[57] ABSTRACT

Spent hydrochloric copper chloride etching solution used in production of printed circuit boards for etching non-galvanized printed circuits is continuously or cyclically regenerated by spraying spent etching liquid from an interconnected etching machine, as with mist projectors, into an upper area of an enclosed regeneration housing, which is also provided with an oxidating gas selected from oxygen, chlorine and a mixture of oxygen and chlorine. The chemical regeneration reaction takes place within the falling mist and a regenerated etching liquid falls to the bottom of the regeneration housing from where it is pumped back to the connected etching machine or station. Two level switches are positioned at different levels within the interior of the regeneration housing to respectively open or close the gas supply so as to equalize the sub-atmospheric pressure arising within the regeneration housing due to gas consumption and thus maintain a relatively slow increase of the etching solution along the bottom of the housing within optimum limits.

8 Claims, 1 Drawing Figure

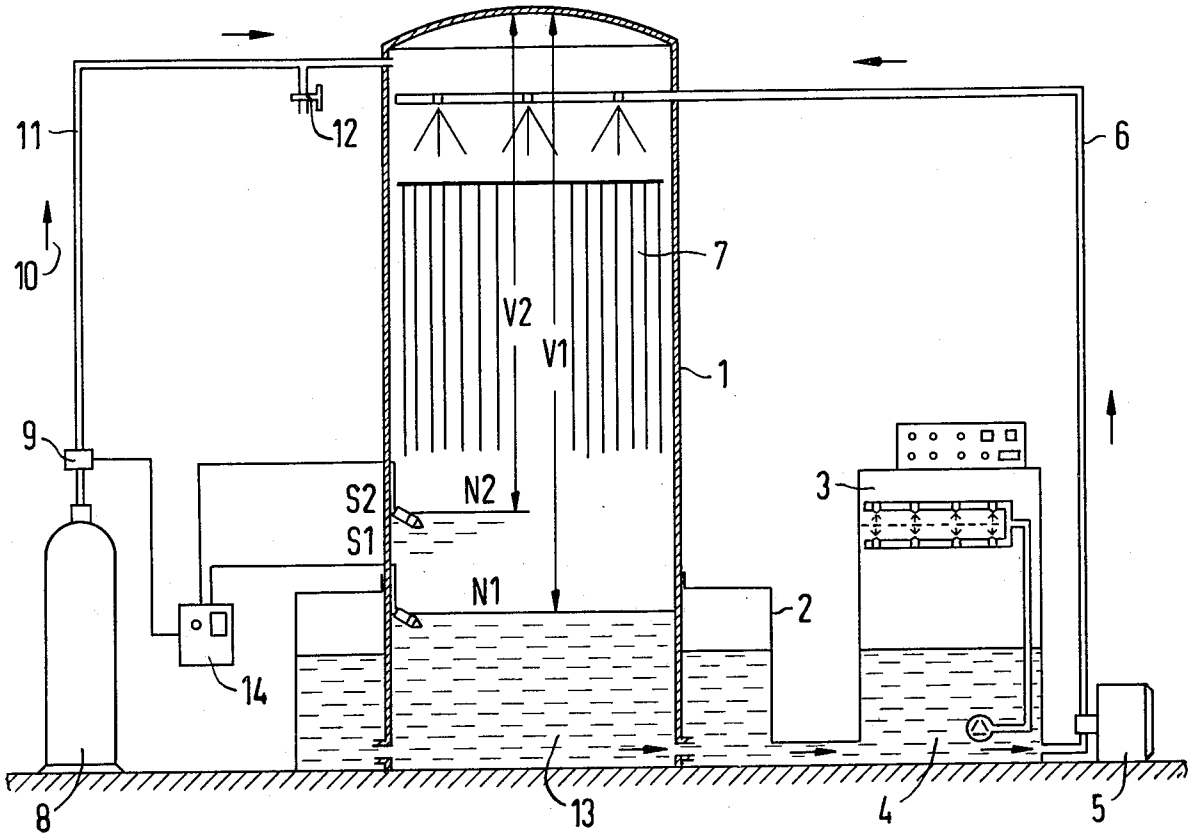
6
5
4
3
2
7
1
V1
V2
N2
N1
13
S2
S1
12
14
11
10
9
8

DEVICE FOR REGENERATING HYDROCHLORIC COPPER CHLORIDE ETCHING SOLUTIONS

BACKGROUND OF THE INVENTION

The invention relates to a device and method for regenerating spent etchant solution and somewhat more particularly to a system for regenerating spent hydrochloric copper chloride etchant solution utilized in printed circuit manufacture for etching non-galvanized printed circuits wherein etching and regeneration occurs in separate devices or stations between which the etchant solution is circulated, either continuously or cyclically and regeneration occurs with preferably oxygen gas.

PRIOR ART

German Pat. No. 1,207,183 describes a system for continuous regeneration, particularly for copper-containing etchant solutions which are utilized in production of printed circuits. The regeneration device comprises a high upright housing having frit-like particles along the floor thereof for fine distribution of supplied compressed air. The etchant solution continuously circulates between the upright housing and an interconnected etching machine. In this system, the following reactions take place:

Etching Process:

$$CuCl_2 + Cu \longrightarrow 2\,CuCl \qquad (I)$$

$$2CuCl + 2Cl^- \longrightarrow 2\,CuCl_2^-$$

Regeneration Process:

$$2CuCl_2^- + 2HCl + \tfrac{1}{2}O_2 \rightarrow 2CuCl_2 + H_2O + 2Cl^- \qquad (II)$$

In the pertinent literature, usually for sake of simplicity, the formation of the readily soluble $CuCl_2^-$ complex from the CuCl salt, which is difficult to dissolve, is not taken into consideration. In regeneration, the relatively inactive copper (I) ion which is formed during etching, is oxidized into the copper (II) ion, which is capable of etching.

German Auslegeschrift No. 16 21 437 describes a device for supplying chlorine gas to an etchant agent regeneration system. The chlorine gas, according to this scheme, is introduced directly into the etchant solution of an etching machine via an injector (water jet-pump principle) whereby the univalent copper (I) ion is oxidized into the divalent copper (II) ion in accordance with the following equation:

$$2CuCl + Cl_2 \rightarrow 2CuCl_2 \qquad (III)$$

German Pat. No. 1,225,465 describes a method of etching copper with a copper (II) chloride solution and regenerating the spent etchant. In this scheme, regeneration takes place in accordance with the following equation:

$$6CuCl + NaClO_3 + 6HCl \rightarrow 6CuCl_2 + NaCl + 3H_2O \qquad (IV)$$

The copper (II) chloride solution is located in a tank. In two separate supply containers, dilute hydrochloric acid and sodium chlorate are kept ready and are respectively added to the etching bath in required amounts by means of an automatic regulating device. The flow of hydrochloric acid is controlled by means of a pH-measuring probe, an amplifier and a control valve and the flow of sodium chlorate is controlled by means of a photo-cell, an amplifier and a control valve.

The magazine ELECKTRONIK, 1969, Pamphlet 11 on pages 335 and 336 includes an article entitled "Modern Etching Methods for Printed Circuits." It is there proposed that the regeneration take place with hydrogen peroxide and hydrochloric acid in accordance with the following equation:

$$2CuCl + H_2O_2 + 2HCl \rightarrow 2CuCl_2 + 2H_2O \qquad (V)$$

Aqueous solutions of hydrogen peroxide and hydrochloric acid are controllably fed into the etching machine in accordance with measurements of the redox potential or, respectively, the pH value.

German Auslegeschrift No. 20 08 766 describes a regeneration process whereby regeneration occurs with an oxygen-containing gas, with recovery of etched copper by means of electrolysis.

SUMMARY OF THE INVENTION

The invention provides an improved system for continuous or cyclical regeneration of hydrochloric copper chloride etching solution by oxygen gas.

In accordance with the principles of the invention, a regeneration housing, generally in the form of a bell-shaped housing, is set-up in a flat upright container having etching fluid therein. The regeneration housing, which preferably is formed of a transparent corrosion-resistant material, is provided with a controllable gas inlet at its upper portion for feeding oxygen, chlorine or a mixture of oxygen and chlorine gas into the regeneration housing. Used or spent etching solution is pumped out of an interconnecting etching machine and sprayed into an upper area of the regeneration housing whereby regenerated etching solution collects along the bottom of such housing and on the floor of the upright container holding the regeneration housing. From the upright container, the regenerated etching solution flows back, as an overflow, into a suitably connected etching machine. Two level switches are positioned at different levels along an interior wall of the regeneration housing for respectively opening or closing the supply line for the regeneration or oxidation gases in order to equalize the subatmospheric pressure (underpressure) arising within the regeneration housing due to gas consumption and thus maintaining a slow increase of etchant solution in the interior of the regeneration housing within optimum limits. As will be appreciated, it is not absolutely necessary to use a bell-shaped housing as a regeneration or oxidation housing. It is only important that the regeneration housing be enclosed so as to be capable of maintaining a controllable oxidation atmosphere within the regeneration housing.

In the practice of the present invention, in contrast to German Pat. No. 1,207,183, no frits are utilized, which according to experience are easily damaged or become plugged-up and as a result, must be replaced. The inventive system, besides the foregoing advantage, requires only slight amount of maintenance and releases no exhaust gases from the regeneration housing.

A further advantage of the invention is that no loss of gas utilized for regeneration occurs, because all of the gas enclosed within the regeneration housing is utilized to 100%. Further, the inventive system operates at a higher regeneration velocity because it works with pure oxygen gas and not with air (20% oxygen content), as in some prior art systems. A further advantage of the invention is the automatic feeding of the gases utilized for regeneration by means of two level switches so that such feeding can be controlled in accordance with demand.

As regeneration gases utilized in the practice of the invention, not only is oxygen gas per se useful but also highly reactive chlorine gas can be used. However, since operating with chlorine gas is often disfavored because of its high chemical aggressiveness, a compromise solution consists in having, for example, the regeneraton or oxidation gas in the regeneration housing composed of from about 80 to 90% oxygen and only up to about 20 to 10% chlorine gas. In this manner, an increase in the regeneration capacity and/or rate in the regeneration housing is attainable.

The concentration of the respective reagents in the etching solution is preferably adjusted in such a manner that no solubility limits are exceeded at a given operating temperature. At room temperature, for example, the following concentrations have proven to be favorable:

$CuCl_2$=1.8 mol/l (=to about 305 gr $CuCl_2.2H_2O$/l)

HCl=1 mol/l (=to about 84 ml conc. HCl/l)

KCl=2.5 mol/l (=to about 185 gr KCl/l).

The salt KCl, is not actually utilized during the etching reaction. It functions as a chlorine ion source for the formation of the readily soluble copper (I) complex, $CuCl_2^-$, and thus provides a means for increasing the reaction rate.

During oxidation of the copper (I) complex, the chlorine ion again becomes free (see equation II, regeneration process).

In an exemplary embodiment, the etching duration for a 35 μm thick Cu coating was 45 minutes at 25° C. and 1 to 1.5 bar etchant spraying pressure.

After consumption of HCl by the etching process, hydrochloric acid and KCl solution are added as required. The overflow can be collected.

The addition of the various chemicals can be made automatic, for example, via a density measurement for the KCl solution and via a pH-measurement for the hydrochloric acid.

Since the regeneration reaction takes place at the phase boundary between the oxidating gas and the sprayed spent etching solution, it is desirabe to design this phase boundary in the regeneration housing so that it is as large as possible. One means of accomplishing an increased phase boundary is to use mist projectors for spraying the spent etching solution into the regeneration housing. Another means for increasing this phase boundary is to position, as by vertical hanging, absorbant and corrosion-resistant webs or felts made of materials which are commercially available, within the regeneration housing. In this connection, it must be pointed out that the regeneration of spent etching solution can take place even with an unenergized spray pump. The absorbancy of a felt having a 2 mm thickness can amount to about 2 liters per square meter of felt material.

BRIEF DESCRIPTION OF THE DRAWING

The single FIGURE is an elevated, somewhat schematic view of a device useful in the practice of the invention.

DESCRIPTION OF PREFERRED EMBODIMENTS

The principles of the invention will be explained with the aid of the schematic illustration of an embodiment of the inventive device for regeneration of a copper chloride etching solution by means of oxygen gas or chlorine gas or a mixture of oxygen and chlorine gas.

In the middle of FIG. 1, a regeneration housing 1, generally in the shape of a bell, is shown positioned in an upright container 2. An etching machine or station 3 is positioned to the right of container 2 and is interconnected therewith so that etching fluid can flow from the container 2 to the bottom of the etching machine 3. The spent etching fluid 4 is moved, as with the aid of a pump 5, from the bottom of the etching machine 3 through a fluid flow line 6 upwardly into the upper area of a chamber defined by the interior wall of regeneration housing 1 and is sprayed over hanging webs or felt cloths 7. An oxidizing gas 10 used for the regeneration reaction is fed from a means 8 for providing such gas and includes a controllable magnetic valve 9 connected through a conduit 11 to the regeneration housing 1. The conduit 11 is provided with a connection 12 for interconnection to a vacuum pump (not shown). In instances where the oxidation gas is relatively pure oxygen, means 8 comprises a single gas pressure cylinder as shown, however, in instances where the oxidation gas is a mixture of oxygen and chlorine, means 8 can comprise a means for providing oxygen to conduit 11 and a means for providing chlorine to conduit 11 so that the gas mixture fed by conduit 11 to the interior of enclosed housing 1 comprises a mixture of about 80 to 90% oxygen and about 20 to 10% chlorine. In the lower part of the regeneration housing 1, the regenerated etching fluid 13 collects. Two level switches S1 and S2 are operationally positioned so that, in dependence on the heights N1 and N2 of the regenerated etching solution 13, the switches turn-on or turn-off the supply of the oxidation gas via a control device 14 operationally coupled to valve 9. The gas volume within the regeneration housing 1 varies between the values V1 and V2.

With the arrows, the cyclical operational path is illustrated. The used etching solution 4 is continuously sucked-out of the etching chamber of the etching machine 3 and is sprayed into the regeneration housing 1 whereby the copper (I) ion, as was already mentioned, is oxidized according to the equation:

$$2CuCl_2^- + 2HCl + \tfrac{1}{2}O_2 \rightarrow 2CuCl_2 + H_2O + 2Cl^- \qquad \text{(II)}$$

By means of consumption of, for example, oxygen, the gas pressure in the regeneration housing continuously decreases. This causes the etching solution 13 within the regeneration housing to slowly increase or rise. The oxygen (or chlorine or oxygen-chlorine mixture) feed is controlled by means of the level switches S1 and S2 (floats or photocells). In this manner, the level of the etching agent in the regeneration housing moves between a lower limit N1 and an upper limit N2 so that there is always sufficient gas present in the regeneration housing for the regeneration reaction. The gas volume varies as a result of this between the values V1 and V2. The bell-shape of the reaction housing 1 is, as earlier explained, in no way critical. The regeneration housing can assume any random form conditioned, for example, by spatial or practical considerations or by the number and size of the felt cloths 7.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

We claim:

1. In a device for regeneration of spent hydrochloric copper chloride etching solution which is utilized in printed circuit board manufacture for etching non-galvanized printed circuits, wherein etching and regeneration occur in separate etching and regeneration means between which the etching solution is circulated cyclically or continuously and regeneration occurs with an oxidizing gas, the improvement comprising wherein: in combination said regeneration means comprises;

an enclosed regeneration housing positioned in a flat upright container which holds a hydrochloric copper chloride etching solution therein, said housing having an interior wall defining a chamber in fluid communication with said upright container;

a means for providing an oxidizing gas in controllable fluid communication with an upper area of said chamber, said oxidizing gas being selected from the group consisting of oxygen, chlorine and a mixture of oxygen and chlorine;

said etching means including a means for providing spent hydrochloric copper chloride etching solution in fluid communication with said upright container and with said upper area of said chamber;

means for spraying said spent etching solution into said upper area of the chamber for contacting said etching solution with said oxidizing gas so that regeneration of said etching solution occurs, consumption of at least a portion of said oxidizing gas occurs and regenerated etching solution collects in said upright container from where such regenerated solution flows back to said etching means; and two level switch means positioned at different levels along the interior wall of said regeneration housing within the chamber thereof for respectively opening and closing said means for providing an oxidizing gas so as to equalize the subatmospheric pressure arising within said chamber because of gas consumption and thus maintain the relatively slow increase of etching solution within said chamber within optimum limits.

2. In a device as defined in claim 1 wherein said means for spraying the spent etching solution into the upper area of the regeneration housing chamber comprises mist projectors so as to enlarge the phase boundary between the sprayed etching solution and the oxidizing gas and thereby increase the rate of regeneration.

3. In a device as defined in claim 1 wherein a plurality of corrosion-resistant and etching solution-absorbant webs are hung across the regeneration housing chamber so as to enlarge the phase boundary between the sprayed etching solution and the oxidizing gas and thereby increase the rate of regeneration.

4. In a device as defined in claim 1 wherein said means for spraying the spent etching solution into the upper area of the regeneration housing chamber comprises mist projectors and a plurality of corrosion-resistant and etching solution-absorbant webs are positioned across said chamber below said mist projectors so as to enlarge the phase boundary between said sprayed etching solution and said oxidizing gas and thereby increase the rate of regeneration.

5. In a device as defined in claim 1 wherein said regeneration housing is bell-shaped.

6. In a device as defined in claim 1 wherein said means for providing oxidizing gas comprises a means for providing oxygen to a conduit in fluid communication with the upper chamber area of the housing and a means for providing chlorine to such conduit so that the gas mixture in the conduit comprises a mixture of about 80 to 90% oxygen and about 20 to 10% chlorine.

7. In a device as defined in claim 1 wherein said regeneration housing is formed of a transparent corrosion-resistant material.

8. In a device as defined in claim 1 wherein a control means is operationally coupled between said level switch means and said means providing an oxidizing gas for controlling the gas volume within said housing.

* * * * *